US005341632A

United States Patent [19]

Jung et al.

[11] Patent Number: 5,341,632

[45] Date of Patent: Aug. 30, 1994

[54] YARN WITH THE APPEARANCE OF A SPUN YARN, MADE FROM POLYAMIDE-BASED FIBRES

[75] Inventors: Emmanuel Jung; Christine Raffin, both of Lyons, France

[73] Assignee: Rhone-Poulenc Fibres, Lyons, France

[21] Appl. No.: 57,420

[22] Filed: May 6, 1993

Related U.S. Application Data

[63] Continuation of Ser. No. 666,640, Mar. 8, 1991, abandoned.

[30] Foreign Application Priority Data

Mar. 16, 1990 [FR] France ..... 90 03643

[51] Int. Cl.[5] ..... D02G 1/02; D02G 3/24; D02G 3/44

[52] U.S. Cl. ..... 57/208; 57/245

[58] Field of Search ..... 57/206, 208, 209, 284, 57/350, 908, 245, 247, 283

[56] References Cited

U.S. PATENT DOCUMENTS

| | | | |
|---|---|---|---|
| Re. 31,376 | 9/1983 | Sheehan et al. | 57/208 |
| 3,780,515 | 12/1973 | Waters | 57/283 X |
| 3,824,776 | 7/1974 | London, Jr. | 57/247 X |
| 4,115,988 | 9/1978 | Nakagawa et al. | 57/208 |
| 4,170,867 | 10/1979 | Leininger | 57/245 |
| 4,244,171 | 1/1981 | Sasaki et al. | 57/208 |
| 4,262,481 | 4/1981 | Otaki et al. | 57/245 |
| 4,365,466 | 12/1982 | Horiuchi et al. | 57/245 X |
| 4,487,011 | 12/1984 | Heinrich et al. | 57/247 |
| 4,712,366 | 12/1987 | Tsujimoto et al. | 57/245 |
| 4,835,956 | 6/1989 | Sasaki et al. | 57/245 |
| 4,845,934 | 7/1989 | Bauer | 57/247 |
| 4,969,322 | 11/1990 | Sasaki et al. | 57/245 X |
| 4,976,097 | 12/1990 | Yanagihara et al. | 57/208 |

FOREIGN PATENT DOCUMENTS

| | | | |
|---|---|---|---|
| 1463462 | 11/1966 | France . | |
| 4736223 | 8/1969 | Japan | 57/208 |
| 1488255 | 10/1977 | United Kingdom . | |

OTHER PUBLICATIONS

Flandarin-Bletty, Maurice, "Technologie et chimie des textiles" Nov. 1988, pp. 105-106.

*Primary Examiner*—Daniel P. Stodola
*Attorney, Agent, or Firm*—Stevens, Davis, Miller & Mosher

[57] ABSTRACT

A yarn with the appearance of a spun yarn, made from polyamide-based filaments. The yarn has crimped bulked parts, and parts which are both tight and interlaced, has a cohesion factor lying between 90 and 140 knots/meter, a Young's modulus lying between 100 and 150 cN/tex, and a difference in orientation between the two populations of filaments, evaluated by measurement of the sonic modulus, lying between 25 and 50 cN/tex. The textile articles obtained from this yarn simultaneously have a soft feel, bulk and strength.

9 Claims, 7 Drawing Sheets

YARN WITH THE APPEARANCE OF A SPUN YARN, MADE FROM POLYAMIDE-BASED FIBRES

This application is a continuation of application Ser. No. 07/666,640, filed Mar. 8, 1991, now abandoned.

BACKGROUND OF THE INVENTION

The present invention relates to a yarn with the appearance of a spun yarn, made from polyamide-based filaments.

Fibrous spun yarns are sought after for their more natural handle than artificial or synthetic continuous-filament yarns in the preparation of woven or knitted fabrics, the latter being dyed and treated subsequently in order to produce, in most cases, garments.

In order to manufacture a conventional fibrous spun yarn, conventional cotton, or worsted or carded wool type spinning methods are used, or less conventional methods such as open-end spinning. However, these methods employ a large amount of equipment and numerous conversion phases to produce the fibrous spun yarn.

Furthermore, for economic reasons, it is advantageous for the conversion processes to which the yarn is subjected to be integrated as much as possible, and for it to be possible to supply the converter with a yarn which can be used directly.

In order to modify the appearance of continuous-filament yarns, various methods have been used such as crimping, texturing by mechanical or pneumatic means, the production of yarns of special section, matt or semi-matt yarns, etc. . . . The results are not satisfactory, however, for certain applications.

Several patents describe the obtaining of yarns with a modified or fancy appearance from continuous-filament yarns. For example the French patents published under the numbers FR 2,004,868, 2,179,971 and 2,208,406 which describe a core yarn comprising continuous-filament core yarns with fixed false twist and sheath yarns surrounding the core in the form of spirals, the direction of which is reversed along the length of the yarn. However, such yarns have a crépe effect and not the appearance of a spun yarn made from fibers similar to spun yarns of natural fibers. Consequently their handle is harsh and not very fibrous.

U.S. Pat. No. 4,845,934 describes a multifilament yarn containing two types of filaments of different denier, the total count of the yarn being equal to at least 100 times the denier of the thinnest filament which itself is less than 1 dtex. This yarn without twist or interlacing cannot have adequate cohesion for permitting trouble-free workability both when weaving and knitting.

The international patent application published under no. WO 89/4389 likewise describes a core yarn comprising two types of different filaments and having parts where the sheath forms inverted spirals around the core yarns, entangled parts and open parts, the ratio between the length of the open parts and that of the closed parts being at least 0.5. However, this yarn has a cohesion factor (40 to 80 closed parts per meter) which is too small to permit good subsequent workability.

EP no. 349,651 discloses a false-twist core/sheath yarn comprising filaments with different denier and extensibility, having interlaced parts, open parts and intertwined parts, the length of the open parts and of the intertwined parts being in a ratio of 1.5 to 4. However, such a yarn has the disadvantage of using, for the sheath, filaments of a very low denier (<0.6) which are industrially expensive and difficult to produce. Moreover it also has a number of interlacing points (50 to 70 per meter) which is insufficient for permitting good workability and the obtaining of textile articles free from faults.

SUMMARY OF THE INVENTION

The present invention relates to a yarn with the appearance of a fibrous spun yarn which makes it possible to obtain textile articles having handle and appearance properties substantially identical to those obtained from spun yarns of natural fibres. By virtue, inter alia, of its high cohesion factor, it is very easy to work both when weaving and knitting. It therefore has a considerable industrial and economic interest.

DESCRIPTION OF THE PREFERRED EMBODIMENT

Figure 1:
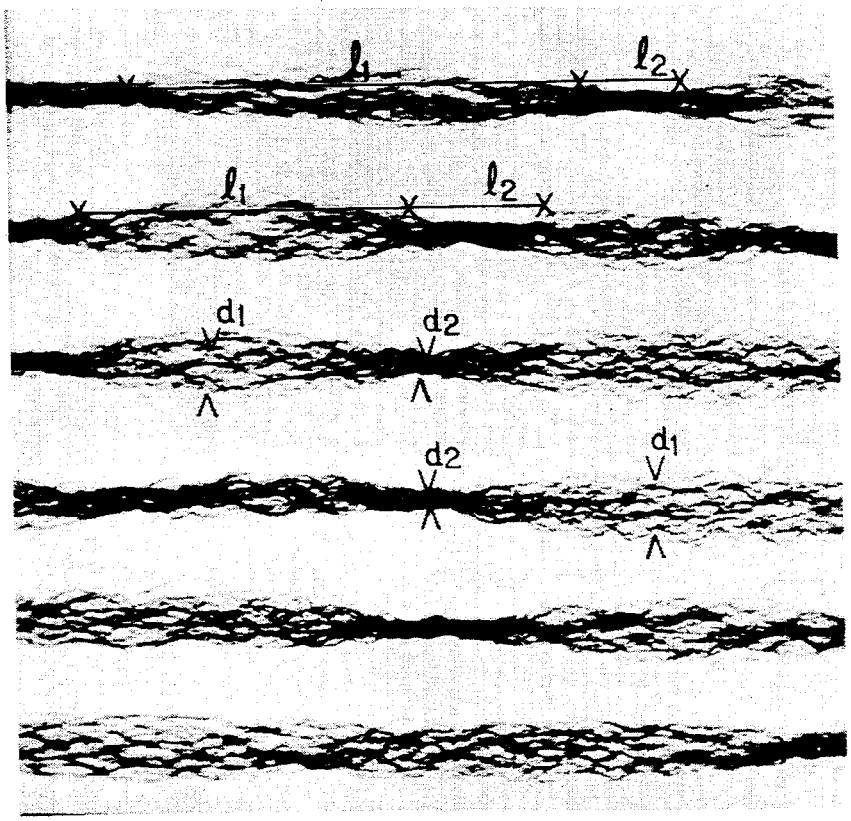
FIGS. 1 and 2 are photographs of the yarn according to the invention, comprising bulked crimped parts of irregular lengths alternating randomly with the points of cohesion both entangled and interlaced.

More particularly, the invention relates to a yarn with the appearance of a fibrous spun yarn, with no twist or spiral, consisting of two populations of filaments differing in denier, filament number and orientation, having randomly alternating crimped bulked parts and tight parts of different lengths, the tight parts being both interlaced and entangled, the cohesion factor lying between 90 and 140 knots per meter, preferably 110 to 130, the Young's modulus lying between 100 and 150 cN/tex, and the difference in orientation between the two populations of filaments, determined by measuring the sonic modulus, lies between 25 and 50 cN/tex.

In the same yarn, the ratio of the lengths $l_1/l_2$ between the lengths of the bulked parts and those of the tight parts lies between 0.6 and 20, and the ratio of the diameters $d_1/d_2$ between the diameters of the bulked parts and the tight parts lies between 1.3 and 8.

The yarns with the appearance of a fibrous spun yarn according to the present invention also have the feature of consisting of individual filaments which have a substantially regular hexagonal shape, visible in section through the two populations of filaments.

One of the essential elements of the yarn with the appearance of a fibrous spun yarn according to the invention (termed "FAF" in the course of the description) consists in the cohesion factor of the yarn lying between 90 and 140, preferably 110 and 130 knots/meter, measured visually by counting under a pretension of 100 mg. This gives the yarn an excellent cohesion permitting good workability both when weaving and knitting, irrespective of the type of loom or knitting machine used. Furthermore, the points of cohesion, or knots, are parts both interlaced and entangled forming neither a loop nor a spiral on the FAF yarn; these tightened points also preserve the soft handle of the remainder of the yarn and do not have any sticking caused by temperature. They are placed at a random distance apart from one another along the yarn; they can, for example, be spaced apart by approximately 2 to 19 mm.

If the cohesion factor is less than 90 knots/m, faults termed "doupions" caused by the filaments of low denier being pushed back onto the filaments of a higher denier, forming an undesirable accumulation of material are observed on the fabrics obtained from the yarns. They are then grouped at the beginning and end of the weft, and accumulate on the selvedges of the fabric. The doupions appear on the fabrics in a darker color.

On the other hand, if the cohesion factor is greater than 140 knots/m, the yarn contains too many closed parts, and the fabric then has a reasonably large number of undesirable sunken parts and lacks bulk.

The FAF yarn according to the present invention has a low Young's modulus lying between 100 and 150, preferably 100 to 120 cN/tex. The Young's modulus E is equal to the tangent of the angle which the load/extension curve makes with the extension axis. E represents the ratio:

$$E = \frac{\text{specific force}}{\frac{\Delta l}{lo}\ \text{corresponding unit}}$$

obtained from the load/extension curve, l being the length of the sample at the instant t to which the actual yarn count corresponds, and lo the initial length of the sample.

The load/extension curve is drawn by means of an "INSTRON 1122" brand dynamometer. The low Young's modulus of the yarns contributes towards giving the textile articles obtained from the FAF yarns according to the invention a particularly soft handle.

The FAF yarn according to the invention consists of two populations of filaments of different orientations evaluated by measuring the sonic modulus, which consists of measuring the change in electric phase caused by the variations in the length of a longitudinal mechanical wave of a yarn which passes between an emitting probe (frequency of 6750 cycles/s) and a receiving probe. These changes in phase, by a simple relation, are a direct representation of the changes in the speed of sound which are, by well-known relations, the image of the changes in modulus.

The sonic or dynamic modulus is directly proportional to the square of the speed of sound in the sample by the density of the material.

$$\text{Sonic modulus (cN/tex)} = 10^{-4}\ C^2\ C \text{ in m/s}$$

The difference in sonic modulus between the two types of filaments lies between 25 and 50 cN/tex, preferably 30 to 40 cN/tex.

The difference in orientation of the yarns corresponds to a difference in the speed at which the feed yarns are spun.

Figure 2:
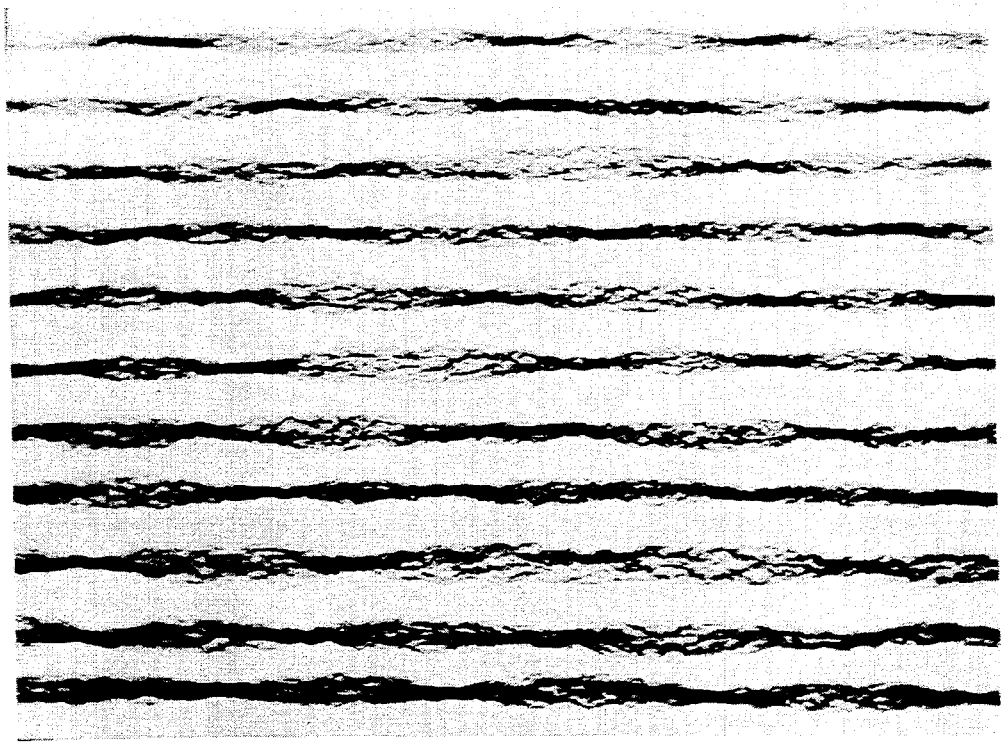

FIGS. 1 and 2 show photographs of the FAF yarn according to the invention, comprising bulked crimped parts of irregular lengths alternating randomly with the points of cohesion both entangled and interlaced.

Along a same yarn, the ratio of lengths $l_1/l_2$ between the bulked parts and the cohesion points lies between 0.6 and 20, and the ratio $d_1/d_2$ of the diameters lies between 1.3 and 8, the values being measured visually, taking an average of 50 measurements.

The bulked parts preferably have a length $l_1$ which lies between 2.25 and 15 mm, and a diameter which lies between 0.8 and 1.9 mm.

The cohesion points preferably have a length which lies between 0.5 and 3.6 mm, and a diameter which lies between 0.18 and 0.60 mm.

In FIGS. 1 and 2, it is difficult to distinguish the yarns of a high count from the yarns of a lower count, even in the open parts, with the result being that it is difficult to distinguish in this yarn core filaments and sheath filaments.

The FAF yarns according to the invention consist of filaments of a low denier, lying between 1 and 2.5 dtex, present in an amount of 20 to 100, and filaments of a higher denier, lying between 3 and 5 dtex, present in an amount of 7 to 40 filaments.

The combination of the filament denier and the number of filaments constitutes an important factor in obtaining an FAF yarn having simultaneously the handle, bulk and strength desired for finished textile articles.

The FAF yarns thus obtained have a low shrinkage in boiling water, generally lying between 2 and 4%, which is favourable for the good workability of the yarns and facilitates the conditions of use for the finished textile articles.

Measurement of the shrinkage of the yarn consists in determining the variation in length of a sample of yarn under a pretension of 200 mg/dtex after heat treatment in 15 mm in boiling water.

$$\%\ \text{shrinkage} = \frac{\text{initial length} - \text{length after heat treatment}}{\text{initial length}} \times 100$$

The individual constituent filaments of the FAF have, in section, the shape of a substantially regular hexagon, in the case of both high and low deniers, which contributes toward giving them a particularly soft handle.

The FAF yarns according to the invention are obtained by a simultaneous drawing/cotexturing process (cf. FIG. 3), in a conventional manner, of two feed yarns spun at different speeds and generally based on polyamide, preferably polyhexamethylene adipamide or copolyamides containing at least 85% hexamethylene adipamide units and up to 15% of other units obtained by replacing, for example, the starting adipic acid by another diacid such as terephthalic, sebacic acid, etc. . . . , or by replacing the two monomers by, for example, caprolactam.

The starting polyamides can also contain additives such as dulling agents, light, heat or oxidation stabilisers, said additives being intended to reduce the accumulation of static charges or to modify the dyeability, etc. . . .

One of the feed yarns is obtained at a speed generally between 1700 and 2200 m/min, and the other at a speed of approximately 4000 to 5000 m/min, which gives them the requisite difference in orientation. The feed yarns are textured to a conventional degree of drawing suitable for the conventional friction texturing of the preoriented yarns; in other words, generally between 1.25 and 1.35×, with the heater being set at 200°–230° C. The textured yarn is subsequently interlaced using an interlacing nozzle which gives the yarn a cohesion factor of 90 to 140 knots/meter, and then has a commercially available texturing oil added to it.

The FAF yarn according to the invention has notable properties in terms of handle, bulk, strength and comfort. It also has a good workability. This makes it possible to obtain textile articles having handle and appearance features similar to those of spun yarns of natural fibers such as cotton.

In particular, these yarns are advantageously used for articles intended to be in contact with the skin. The structure of the yarn makes it possible to obtain textile articles which at the same time have a better covering power for a lower density than the FAF yarns known hitherto. This structure also gives the textile articles strength and liveliness and, consequently, good crease resistance.

Furthermore, such yarns have, as compared with spun yarns of fine fibres (>Nm 50 or 200 dtex), significant advantages in terms of cost and implementation such as warping, weaving, and handling.

They also make it possible to obtain lightweight fabrics of identical performance.

They therefore have a considerable economic and industrial interest.

The yarns thus obtained can be used in the preparation of fabrics, either 100% FAF or as warp or weft (mixed fabrics: for example continuous warp, FAF weft—FAF warp, fibrous spun yarn weft) and circular and run-resistant knitted fabrics for the following preferred uses:

- Fabrics: sports fabrics, sportswear fabrics, dresses, household linen, men's shirts
- Stitch: circular stitch:
  - large-diameter knitting machines: dresses, tracksuits, sports shirts, undergarments
  - small-diameter knitting machines: footwear
- run-resistant stitch: dresses, sportswear, printing backgrounds In the examples below, the tenacity is measured on a commercially available apparatus of the INSTRON 1122 brand, taken as an average of 20measurements, connected to a calculator indicating:

- the initial count (dtex)
- the breaking force (cN) (=maximum force which the sample can sustain)

$$\text{Tenacity in } cN/tex = \frac{\text{breaking force } (cN)}{\text{initial count } (tex)}$$

$$\text{The secant modulus at } 8\% = \frac{\text{specific force } (cN/tex)}{\Delta l/lo}$$

obtained from the load/extension curve for an elongation of 8% where:

- l=increase in initial length
- lo=initial length
- The "Degree of folding-up"=difference in length between the filaments of lowest count and that of the filaments of higher count, with respect to the length of filaments of high count.

EXAMPLE 1

Starting from a polyhexamethylene adipamide of relative viscosity 42, measured on an 8.4% solution in 90% formic acid, two continuous-filament yarns are produced:

- one (1), extruded at 4200 m/min, dulled with 0.3 by weight of titanium oxide, protected against light with 7 ppm of manganese, of count 98 dtex/17 filaments,
- the other (2), extruded at 2200 m/min, dulled and protected against light in the same way as the first yarn, of count 140 dtex/50 filaments.

Figure 3:
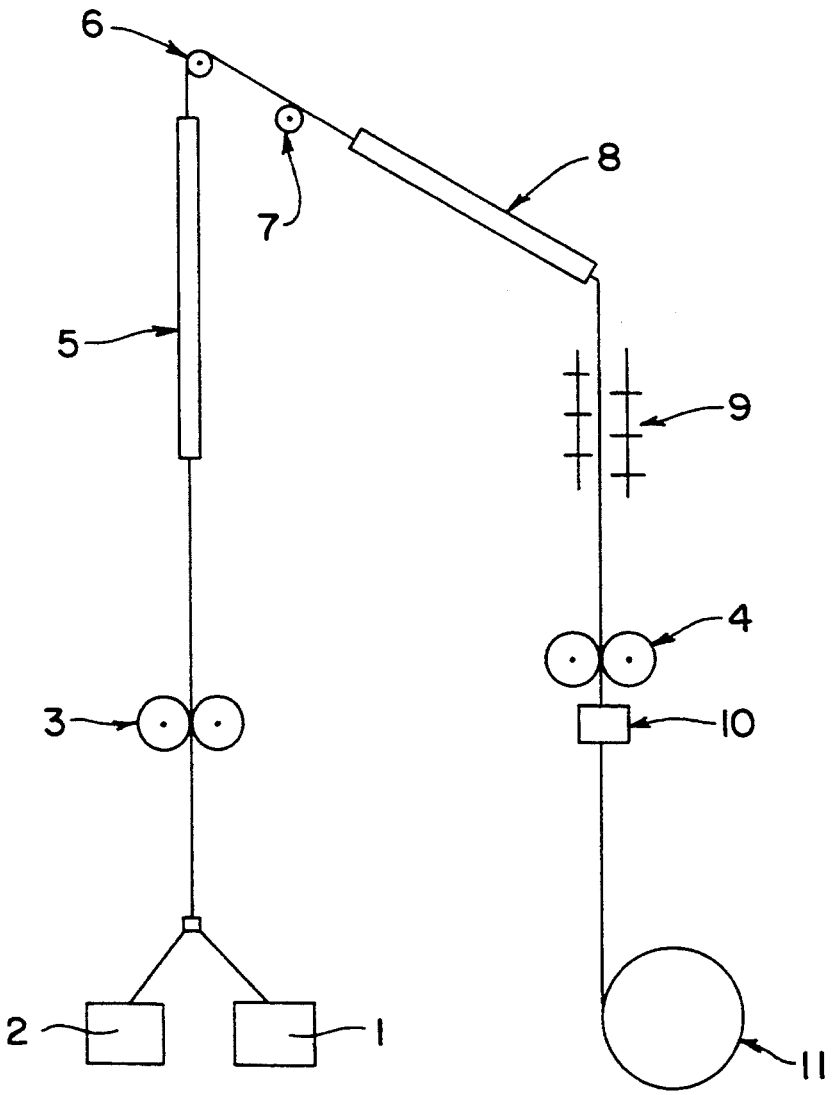
FIG. 3 is the apparatus employed in Example 1.
Figure 4:
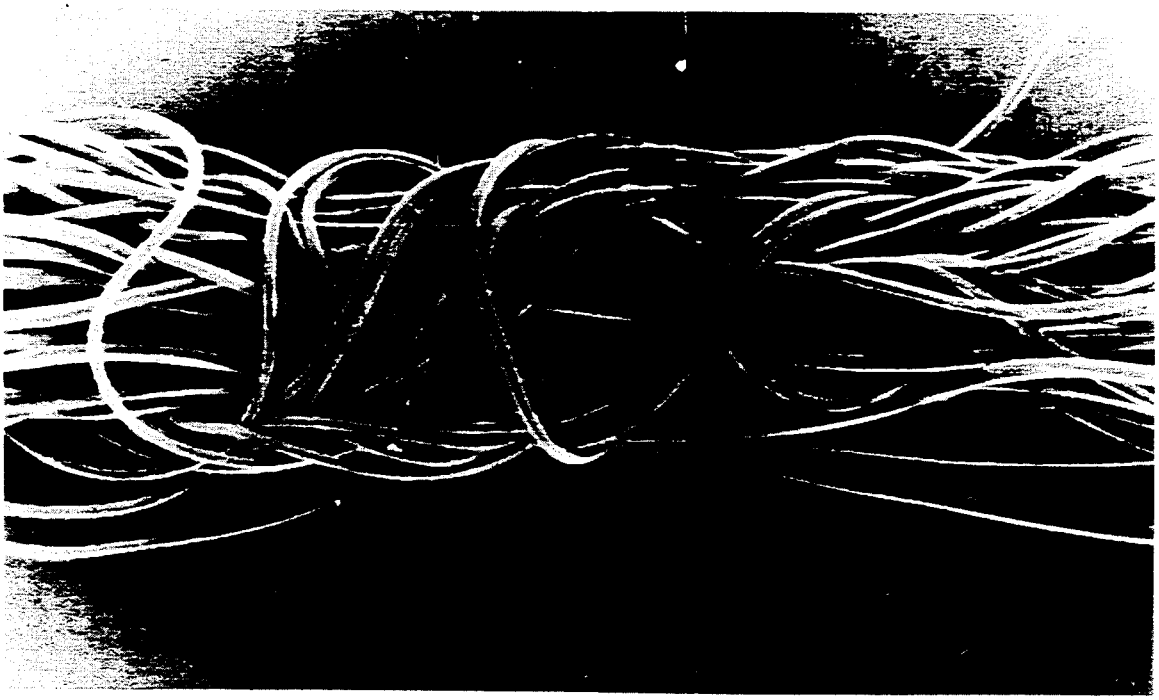
FIG. 4 is a photograph of a yarn of the claimed invention, having both entangled and interlaced parts.
Figure 7:
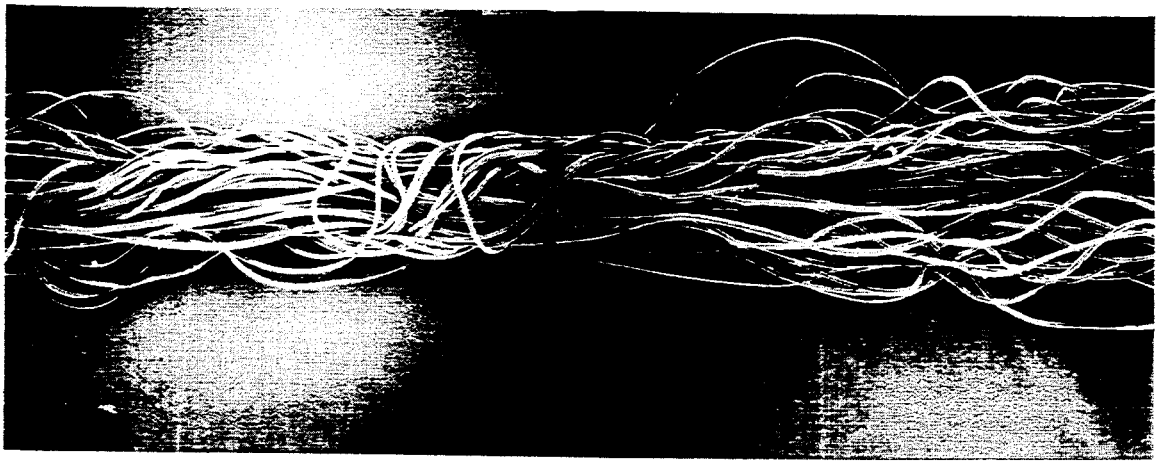
FIG. 7 is a photograph of another yarn of the claimed invention, having both entangled and interlaced filaments.
Figure 5:
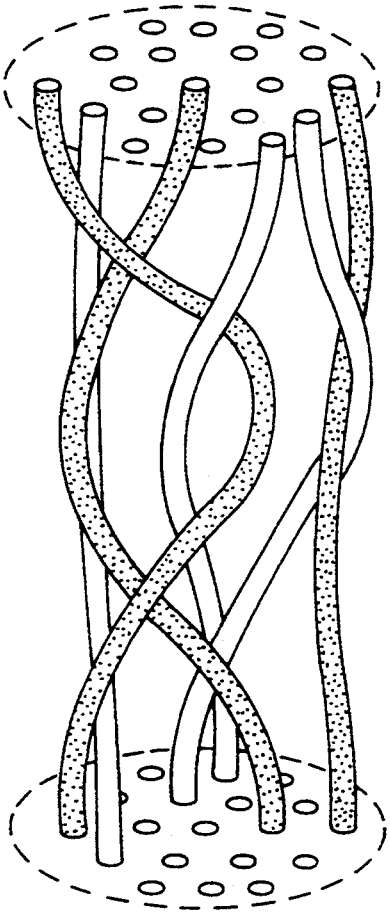
FIGS. 5 and 6 are illustrations of entangled filaments and interlaced filaments.
Figure 6:
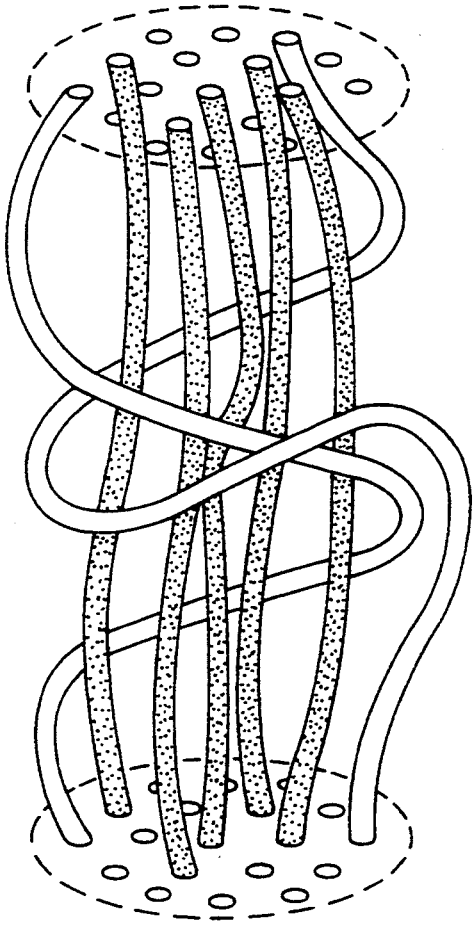
Figure 8:
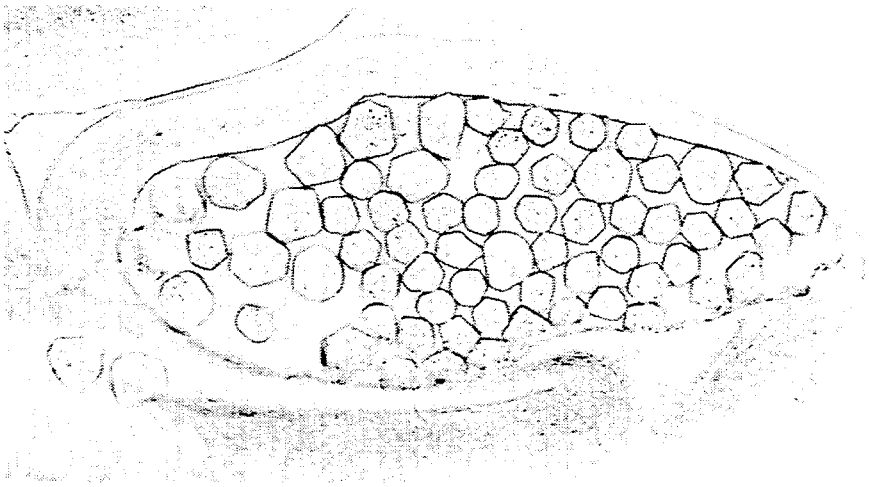
FIG. 8 is a photograph of a yarn of the claimed invention, showing the hexagonal cross-section of the filaments and the two populations thereof.
Figure 9:
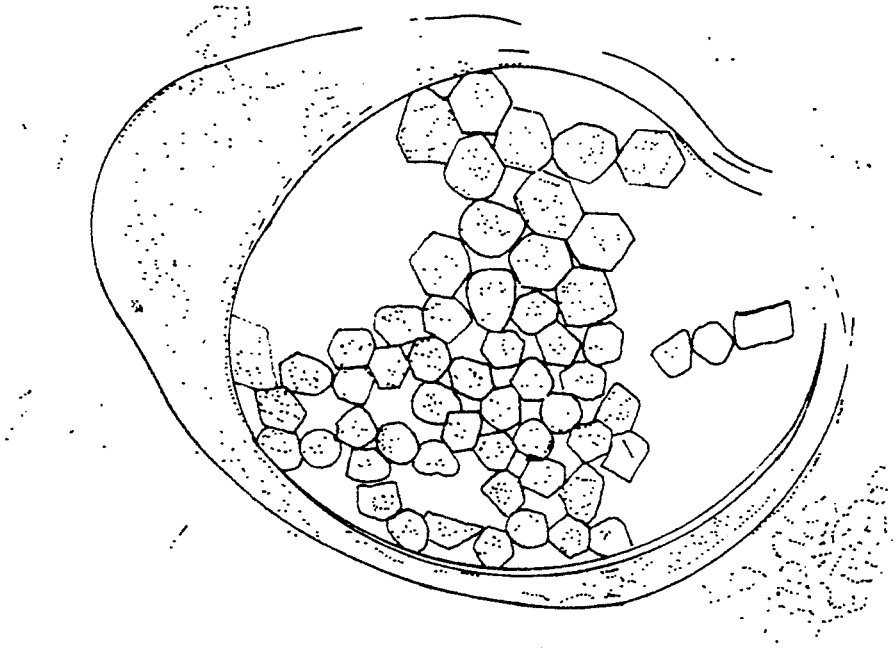
FIG. 9 is an illustration of a yarn, as shown in FIG. 8.
Figure 10:
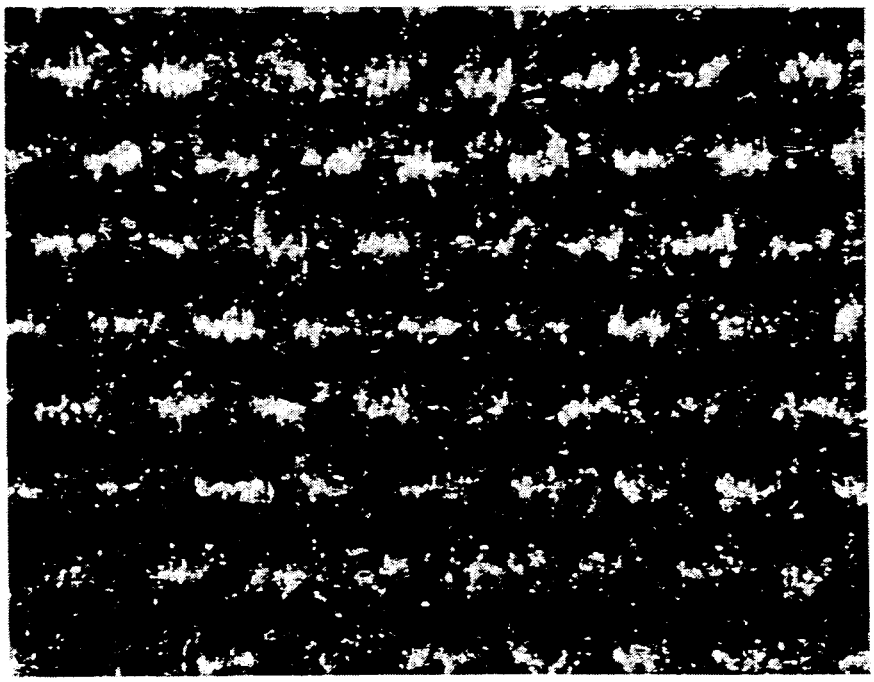
FIG. 10 is a photograph of a woven fabric of the claimed invention.
Figure 11:
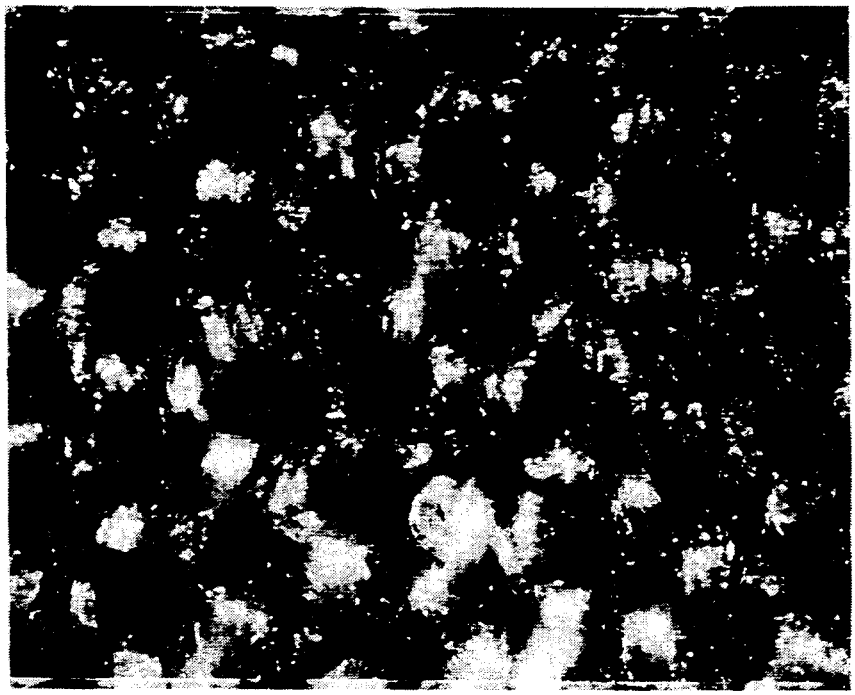
FIG. 11 is a photograph of a knitted fabric of the claimed invention.

The two yarns are introduced into a simultaneous drawing/texturing machine of the "ARCT FT 190" type. With reference to FIG. 3, the two yarns (1) and (2) are fed from two different bobbins and then pass between a pair of input rolls 3 rotating at a speed $V_1$. The single-covered yarns are subjected to a false twist while they are being drawn at a rate of 1.272 between the rolls 3 and the rolls 4 rotating at a speed $V_2$ of 650 m/min. During the false-twisting process, the yarn passes through the heater 5 maintained at a temperature of 225° C., in which the drawing takes place, then passes onto the return guides 7 and onto the cooling plate 8. It is twisted by the friction spindle 9 (trademark POSITORQ 2) upstream of the friction spindle 9, under a tension $T_1$, and then is untwisted downstream of the spindle under a tension $T_2$. The friction spindle comprises 9 discs. The yarn then passes between the rolls 4 rotating at a speed $V_2$.

Rate of drawing: $V_2/V_1 \ldots = 1.272$
Ratio of tensions $T_2/T_1 \ldots = 0.85$
$D/Y \ldots = 2.13$ The yarn then passes into an interlacing nozzle (10) fed with compressed air at a pressure of 3.5 bar after having oil added to it in the usual manner. It is wound onto a bobbin (11) with a contraction of 4.99% in order to permit a good package build.

The characteristics of the yarn obtained are as follows:

- overall count in dtex . . . 195
- number of filaments . . . 67
- degree of folding up in % . . . 9.7
- tenacity in cN/tex . . . 25
- elongation in % . . . 22.8
- Young's modulus in cN/tex . . . 120
- modulus at 8% elongation in cN/tex 143
- cohesion factor in knots/meter . . . 135
- shrinkage in % . . . 3
- shrinkage force (cN) . . . 6.66
- difference in the sonic modulus of the two constituents in cN/tex . . . 30
- $l_1/l_2$ . . . 3.2 to 10.9
- $d_1/d_2$ . . . 1.4 to 8.4
- the length of the bulked parts 11 varies from 2.9 to 7.7 mm
- the diameter of the bulked parts $d_1$ varies from 0.9 to 1.8 mm
- the length of the interlaced parts 12 varies from 1.1 to 3.5 mm
- the diameter of the interlaced parts $d_2$ varies from 0.3 to 0.47 mm

EXAMPLE 2

Example 1 is reproduced using the same feed yarns spun at the same speed and using the same texturing process with the following settings:

speed at the rolls 4 . . . 650 m/min
rate of simultaneous drawing . . . 1.3 X
D/Y . . . 2.11
temperature of heater . . . 225° C.
pressure at interlacing nozzle . . . 3.5 bar
receiving contraction in % . . . 6.66
ratio of tensions . . . 0.66
feed yarns: 97.1 dtex/17 filaments and 147 dtex/50 filaments
Characteristics of the textured yarn
overall count in dtex . . . 191.8
number of filaments . . . 67
degree of folding up in % . . . 7
tenacity in cN/tex . . . 22.4
cohesion factor in hots/meter . . . 114
Young's modulus in cN/tex . . . 116
modules at 8% elongation in cN/tex 139
shrinkage in % . . . 3.1
difference in the sonic modulus of the two constituents in cN/tex . . . 39
$l_1/l_2$ lying between . . . 0.625 and 12
$d_1/d_2$ lying between . . . 1.6 and 7.9
$l_1$ varies from 3.1 to 9.9 mm
$l_2$ varies from 1.1 to 3.55 mm
$d_1$ varies from 0.9 to 1.85 mm
$d_2$ varies from 0.32 to 0.52 mm

EXAMPLE 3

Example 1 is reproduced using as the feed yarns a yarn extruded at 4200 m/min, dulled and protected against light, of a count 42.8 dtex/10 filaments, and a yarn extruded at 2200 m/min of a count 75 dtex/23 filaments.

The yarns are textured using the process indicated in Example 1, with the following settings:
speed at the roll 4 . . . 650 m/min
rate of simultaneous drawing . . . 1.31 X
D/Y . . . 2.13
temperature of heater . . . 220° C.
pressure at interlacing nozzle . . . 3.5 bar
receiving contraction in % . . . 6.23
$T_2/T_1$ . . . 1.16
Characteristics of the textured yarn:
overall count in dtex . . . 93.8
number of filaments . . . 33
tenacity in cN/tex . . . 19.8
elongation in % . . . 17.9
cohesion factor in knots/meter . . . 117
Young's modulus in cN/tex . . . 123
modulus at 8% elongation in cN/tex 141
shrinkage in % . . . 2.5
difference in the sonic modulus of the two constituents in cN/tex . . . 30
$l_1/l_2$ lying between . . . 1.33 and 19.68
$d_1/d_2$ lying between . . . 1.65 and 7.5
$l_1$ varies from 3.6 to 14 mm
$l_2$ varies from 0.725 to 2.7 mm
$d_1$ varies from 0.68 to 1.36 mm
$d_2$ varies from 0.18 to 0.41 mm

EXAMPLE 4

From polyhexamethylene adipamide of relative viscosity 42, measured on an 8.4% solution in 90% formic acid, two continuous-filament yarns are produced:
one (1), extruded at 4200 m/min, dulled with 0.3% by weight of titanium oxide, protected against light with ppm of manganese, of count 42 dtex/7 filaments,
the other (2), extruded at 2000 m/min, dulled and protected against light in the same way as the first yarn, of count 60 dtex/30 filaments.

The two yarns are introduced into a simultaneous drawing/texturing machine of the "ARCT FT 190" type. With reference to FIG. 3, the two yarns (1) and (2) are fed from two different bobbins and then pass between a pair of input rolls 3 rotating at a speed $V_1$. The single-covered yarns are subjected to a false twist while they are being drawn at a rate of 1.32 between the rolls 3 and the rolls 4 rotating at a speed $V_2$ of 650 m/min. During the false-twisting process, the yarn passes through the heater 5 maintained at a temperature of 220° C. in which the drawing takes place, and then passes onto the return guides 7 and onto the cooling plate 8. It is twisted by the friction spindle 9 (trademark POSITORQ 2) upstream of the latter, under a tension $T_1$, and is then untwisted downstream of the spindle under a tension $T_2$. The friction spindle comprises 9 discs. The yarn then passes between the rolls 4 rotating at a speed $V_2$.
Rate of drawing: $V_2/V_1$ . . . =1.32
Ratio of tensions $T_2/T_1$ . . . =0.83
D/Y . . . =2.3

The yarn then passes into an interlacing nozzle (10) fed with compressed air under a pressure of 3.5 bar after having had oil added to it in the usual manner. It is wound onto a bobbin (11) with a contraction of 5% in order to permit a good package build.

The characteristics of the yarn obtained are as follows:
overall count in dtex . . . 79.4
number of filaments . . . 37
degree of folding up in % . . . 6.4
tenacity in cN/tex . . . 32.6
elongation in % . . . 24.5
Young's modulus in cN/tex . . . 130
modulus at 8% elongation in cN/tex 147
cohesion factor in knots/meter . . . 101
shrinkage in % . . . 1.9
difference in the sonic modulus of the two constituents in cN/tex . . . 30
$l_1/l_2$ . . . from 0.9 to 20
$d_1/d_2$ . . . from 1.3 to 6
the length of the bulked parts $l_1$ varies from 3.4 to 12 mm
the diameter of the bulked parts $d_1$ varies from 0.8 to 1.8 mm
the length of the interlaced parts $l_2$ varies from 0.6 to 3.6 mm
the diameter of the interlaced parts $d_2$ varies from 0.3 to 0.6 mm

We claim:

1. A spun yarn made of polyamide filaments, said yarn being without twist, spirals or loops, consisting of two populations of filaments differing in denier, filament number and orientation, and having randomly alternating crimped bulked parts and tight parts of different lengths $l_1$ and $l_2$, $l_1$ being the length of the bulked parts and $l_2$ being the length of the tight parts, wherein:
the tight parts are both interlaced and entangled,
the cohesion factor lies between 90 and 140 knots/m,
the Young's modulus lies between 100 and 150 cN/tex, and
the difference in the sonic modulus between the two populations of filaments is between 25 and 50 cN/tex., and represents the difference in orientation therebetween.

2. A yarn according to claim 1, wherein:

the ratio of the lengths $l_1/l_2$ between the bulked parts and the tight parts lies between 0.6 and 20, and the ratio of the diameters $d_1/d_2$ between the bulked parts and the tight parts, $d_1$ being the diameter of the bulked parts and $d_2$ being the diameter of the tight parts, lies between 1.3 and 8.

3. A yarn according to claim 1, wherein:

the length of the bulked parts ($l_1$) lies between 2.25 and 15 mm, the length of the interlaced parts ($l_2$) lies between 0.5 and 3.6 mm, the diameter of the bulked parts ($d_1$) lies between 0.8 and 1.9 mm, and the diameter of the interlaced parts ($d_2$) lies between 0.18 and 0.60 mm.

4. A yarn according to claim 1, wherein the filaments of low denier have a denier between 1 and 2.5 dtex, and the filaments of higher denier have a denier between 3 and 5 dtex.

5. A yarn according to claim 1, wherein the lowest-denier filaments number 7 to 40 filaments, and the highest-denier filaments number 20 to 100.

6. A yarn according to claim 1, wherein the Young's modulus lies between 100 and 120 cN/tex.

7. A yarn according to claim 1, wherein the difference in the sonic modulus lies between 30 and 40 cN/tex.

8. A yarn according to claim 1, wherein all the filaments constituting the spun yarn have, in section, a substantially regular hexagonal shape.

9. A spun yarn made of polyamide filaments, said yarn being without twist, spirals or loops, consisting of two populations of filaments differing in denier, filament number and orientation, and having randomly alternating crimped bulked parts and tight parts of different lengths $l_1$ and $l_2$, $l_1$ being the length of the bulked parts and $l_2$ being the length of the tight parts, wherein:

the tight parts are both interlaced and entangled, the cohesion factor lies between 90 and 140 knots/m, the Young's modulus lies between 100 and 150 cN/tex, the difference in the sonic modulus between the two populations of filaments is between 25 and 50 cN/tex, and represents the difference in orientation therebetween, the filaments of low denier having a denier between 1 and 2.5 dtex, and the filaments of higher denier having a denier between 3 and 5 dtex.

* * * * *